US005493315A

United States Patent [19]

Atchley

[11] Patent Number: 5,493,315

[45] Date of Patent: Feb. 20, 1996

[54] VIDEO DISPLAY CONTROL

[75] Inventor: Hans B. Atchley, Greensboro, N.C.

[73] Assignee: Gilbarco Inc., Greensboro, N.C.

[21] Appl. No.: 271,553

[22] Filed: Jul. 7, 1994

Related U.S. Application Data

[63] Continuation of Ser. No. 960,515, Oct. 13, 1992, abandoned.

[51] Int. Cl.[6] ..... G09G 5/00

[52] U.S. Cl. ..... 345/200; 345/185; 345/162; 395/166; 395/600; 364/405; 86/36; 235/381

[58] Field of Search ..... 345/115, 200, 345/185, 133, 192, 116, 162; 340/825.35; 364/405, 406; 395/164, 166, 160, 600; 348/719; 186/35, 36; 235/425, 381, 378, 432

[56] References Cited

U.S. PATENT DOCUMENTS

| | | | |
|---|---|---|---|
| 3,931,497 | 1/1976 | Gentile et al. | 340/825.35 |
| 4,047,248 | 9/1977 | Lyman et al. | 345/141 |
| 4,189,031 | 2/1980 | Vayda | 186/36 |
| 4,449,186 | 5/1984 | Kelly et al. | 364/407 |
| 4,574,364 | 3/1986 | Tabata et al. | 345/119 |
| 4,589,069 | 5/1986 | Endo et al. | 340/825.35 |
| 4,677,565 | 6/1987 | Ogaki et al. | 364/479 |
| 4,780,710 | 10/1988 | Tatsumi | 345/120 |
| 4,967,366 | 10/1990 | Kaehler | 340/825.35 |
| 5,027,110 | 6/1991 | Chang et al. | 345/132 |
| 5,053,956 | 10/1991 | Donald et al. | 364/401 |
| 5,091,720 | 2/1992 | Wood | 345/185 |
| 5,119,082 | 6/1992 | Lumelsky et al. | 345/132 |
| 5,133,070 | 7/1992 | Barker et al. | 395/650 |
| 5,136,695 | 8/1992 | Goldshlag et al. | 345/190 |
| 5,165,030 | 11/1992 | Barker | 395/500 |
| 5,383,027 | 1/1995 | Harvey et al. | 358/296 |

FOREIGN PATENT DOCUMENTS

| | | |
|---|---|---|
| 0284764 | 10/1988 | European Pat. Off. . |
| 2389185 | 4/1978 | France . |
| 1573466 | 8/1980 | United Kingdom . |
| WO89/00974 | 2/1989 | WIPO . |

OTHER PUBLICATIONS ((C Through Unit)) by Kenneth E. Martin Wm. C. Brown Publishers 1992. pp. 256 and 274–281.

JP1273173 (Jan. 1989)–Japan (Abstract).

*Primary Examiner*—Richard Hjerpe
*Assistant Examiner*—Lun-Yi Lao
*Attorney, Agent, or Firm*—Rhodes Coats & Bennett

[57] ABSTRACT

An apparatus for displaying video information includes a video display screen, a screen buffer, a frame buffer, and a video image data assembly module. The module assembles data from linked lists of screen objects, segment objects and field objects which identify images stored in the frame buffer into video image data to store in the screen buffer to be displayed on said screen. Data elements in the lists are linked in a hierarchical arrangement of most-significant to least-significant data elements, with significance denoted by the usual size of the data element as displayed on said screen, so that selecting data from an upper one of the members of a hierarchical list thereby selects data from a lower member by virtue of the linking of the lower member to the upper member. A television signal source supplies television signals to the video image data assembly module as data for one of the linked lists, A communication link to the video image data assembly module receives data to be listed in a linked list for display and data indicative of which of the linked lists is to be selected for assembly into the video image.

37 Claims, 16 Drawing Sheets

(SCREEN #1)

(SCREEN #2)

(SCREEN #3)

(SCREEN #4)

VIDEO DISPLAY CONTROL

This application is a continuation of application Ser. No. 07/960,515 filed Oct. 13, 1992 now abandoned.

BACKGROUND OF THE INVENTION

The present invention relates to improvements in arranging data for a video display. In particular, it has applicability to upgrade existing fuel dispenser to permit video displays to be incorporated in the fuel dispensers.

Gilbarco, Inc., of Greensboro, N.C., the assignee of this application, has for several years sold a line of gasoline dispensers under the trademark THE ADVANTAGE, having what is called CRIND characteristics. CRIND is an acronym for "Card Reader IN Dispenser" referring to the fact that the dispenser located on the service station island can have a credit card or debit card inserted into it. The CRIND will read the card and transmit information concerning the card to a site controller. The site controller will then transmit the information to a credit or debit card verifying authority to obtain an authorization to charge a fuel transaction to the associated account. The CRIND also receives data from a fuel pump in the dispenser and displays data on conventional readouts on the dispenser housing. Further, it generates messages for a single line LED display to instruct the user how to proceed at the various steps of the transaction. In addition, the LED display might show simple greetings or other commercial messages to a customer.

It would be desirable to incorporate a television-like screen in a CRIND dispenser so that the messages which can be communicated to the customer can be considerably more complex than those capable of being displayed on single line LED display. However, a considerable number of service stations already are equipped with CRIND-type fuel dispensers which, while capable of generating versatile messages, cannot generate messages at a reasonable rate to take advantage of the flexibility afforded by full video screens.

Accordingly, in order to display elaborate messages on the video screen in varying fonts or varying arrangements on the screens, varying coloring or the like, an extensive amount of existing fuel dispensing equipment would have to be replaced. This would be prohibitively expensive and wasteful.

Therefore, there remains a need in the art for a video display controller capable of receiving simple, terse messages and constructing from them relatively elaborate screen displays.

The primary emphasis in this application will be on the use of a technique in a fuel dispenser, but it should be understood that the technique is not limited to fuel dispensers, but could be adapted to a wide variety of video display installations in which only relatively simple communication links to the video display are available. Other samples would be signals transmitted by carriers of limited band width, or the like, so that the data transmission rate is not great, but relatively elaborate video images can be displayed.

SUMMARY OF THE INVENTION

The present invention fulfills this need in the art by providing an apparatus for displaying video information including a video display screen, and a video image data assembly module. The module assembles data from references in linked lists of data, including screen objects and segment objects into video image data to be displayed on the screen. The apparatus may also be generally considered as a video display screen, and a video image data assembly module for assembling data from references in linked data structures, including screen objects and segment objects into video image data to be displayed on the screen.

A particularly preferred embodiment of the invention includes a fuel dispenser for dispensing fuel. It includes a fuel delivery mechanism, a transaction computer, and apparatus for displaying video information to a fuel customer including a video display screen, and a video image data assembly module for assembling data from references in linked lists of data, including screen objects and segment objects into video image data to be displayed on the screen.

In one embodiment the video image data assembly module assembles the image data from identification of stored images in a frame buffer. Preferably, the video image data assembly module assembles the image data from references in linked lists of screen objects, segment objects and field objects. The linked lists may also include display object references. The video image data assembly module may store the assembled image data in a screen buffer.

Preferably, the video image data assembly module assembles the image data from references in linked lists in which the data elements in the lists are linked in a hierarchical arrangement of most-significant to least-significant data elements, with significance denoted by the type of data element. As a general rule, subject to exceptions, the significance may relate to the usual size of the data element as displayed on the screen. Typically, the video image data assembly module selects data from an upper one of the members of a hierarchical list, and thereby selects data from a lower member by virtue of the linking of the lower member to the upper member. However, a lower member may be selected and thereby define upper members, or an intermediate member may be selected, and thereby define both higher and lower members. Also, the assembly module can be instructed to select and display only specific data elements independent of all others linked to it.

Preferably, the video image data assembly module includes a communication link to receive data to be listed in a linked list for display. The video image data assembly module may assemble the image data from a plurality of groups of linked lists, one group defining the sizes and arrangements of screens, screen segments and fields within segments, a second group defining data to be displayed in a field or segment, and a third group defining fonts of typefaces for alphanumeric characters of the data to be displayed in the respective fields or segments.

A television signal source may supply television signals to a portion of the video screen as directed by the image data assembly module. The video image data assembly module preferably includes a communication link to receive data indicative of which of the linked lists is to be selected for assembly into the video image and acts on such received data to assemble the video image.

The invention also provides a method of displaying video information including providing a video display screen, and electronically assembling data from references in linked lists of data, including screen objects and segment objects into video image data to be displayed on the screen.

The assembling step may include assembling the image data from identification of stored images in a frame buffer. The assembling step may include storing the assembled image data in a screen buffer. Preferably, the assembling step includes assembling the image data from references in linked lists of screen objects, segment objects and field objects.

The assembling step may include assembling the image data from references in linked lists in which the data elements in the lists are linked in a hierarchical arrangement of most-significant to least-significant data elements, with significance denoted by the type of data element.

In one embodiment the assembling step includes selecting data from an upper one of the members of a hierarchical list, and thereby selecting data from a lower member by virtue of the linking of the lower member to the upper member. However, a lower member may be selected and thereby define upper members, or an intermediate member may be selected, and thereby define both higher and lower members. Also, a specific data element may be selected and displayed independent of all others linked to it.

Typically, the assembling step includes receiving data to be listed in a linked list for display.

In a preferred embodiment the assembling step includes assembling the image data from a plurality of groups of linked lists, one group defining the sizes and arrangements of screens, screen segments and fields within segments, a second group defining data to be displayed in a field or segment, and a third group defining fonts of typefaces for alphanumeric characters of the data to be displayed in the respective fields or segments. The method may include supplying television signals as data for one of the linked lists. Typically, the assembling step includes receiving data indicative of which of the linked lists is to be selected for assembly into the video image and acting on such received data to assemble the video image.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
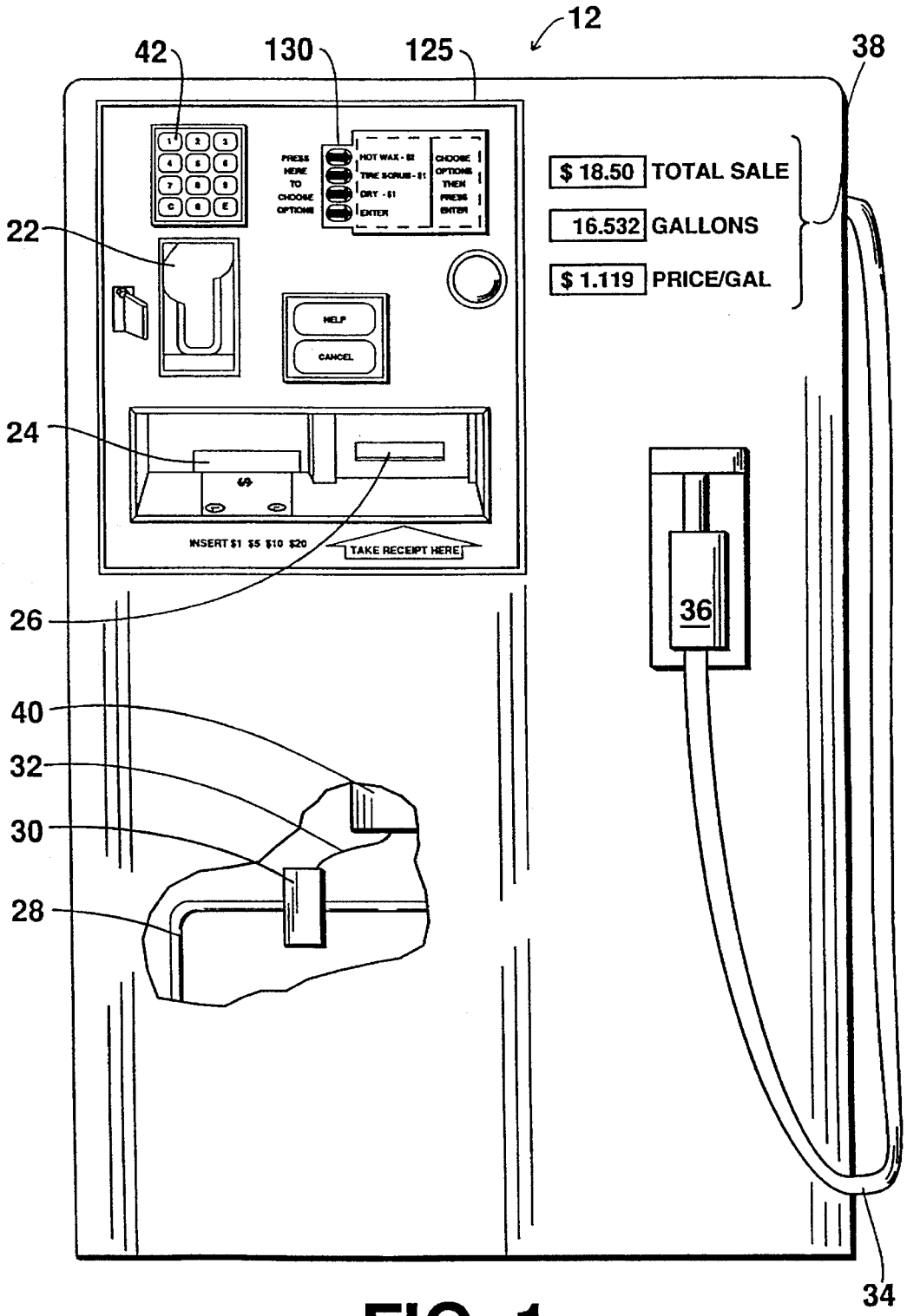
FIG. 1 is an elevation view of an embodiment of the invention as a fuel dispenser, partially broken away to show interior components.

FIG. 1 is an elevation view of a fuel dispenser according to the present invention. As will be appreciated, the invention can be embodied in video displays located other than in fuel dispensers.

The fuel dispenser 12 includes a fuel delivery line 28 having a fuel pump metering device 30. The metering device 30 communicates the volume of liquid being pumped through line 28 along a communication cable 32 to a microprocessor unit 40. The fuel pumped along line 28 is available for discharge from a nozzle 36 attached to a hose 34.

The microprocessor unit 40 is desirably comparable to the microprocessors used in CRIND type units sold by Gilbarco, Inc. under the trademark THE ADVANTAGE. The CRIND microprocessor has the capability of communicating with a card reader 22 or a cash acceptor 24 and a receipt printer 26. In doing so, it can read data from a magnetic stripe on a card inserted in the card reader 22, and communicate to a service station-based microprocessor apparatus such as the G-Site controllers sold by Gilbarco, Inc. of Greensboro, N.C. The G-Site controller then can communicate with a remote credit card verification authority to ascertain whether a transaction to be charged to the account associated with the credit card inserted in the card reader 22 is authorized. The CRIND 40 has in the past communicated with a single line LED display to display instructions to the user as to procedures to follow in the transaction. Other simple messages might also be included, but they are limited to brief alphanumeric displays which can be contained on the one-line LED display. The foregoing capabilities of the microprocessor 40 are known capabilities from the existing CRIND apparatus.

In the present invention, the CRIND microprocessor 40 is upgraded slightly to output a different message text, but the message is still rather terse, limited by the existing capabilities of the CRIND message generation facilities. However, the present invention includes enhanced message receiving and interpreting capabilities so that the message output by the CRIND microprocessor 40 is used to display a much more elaborate message on a raster-scannable screen 125. The screen 125 can be a cathode ray tube, a liquid crystal display or other apparatus in which the data elements are displayed in a raster-scanned fashion. However, with the methodology of the present invention, the display need not be limited to a raster-scannable display. Most particularly preferred is an active matrix, color, liquid crystal display with a backlight. This provides an excellent picture using solid state electronics, thereby avoiding the use of the fragile cathode ray tubes in the fuel dispensers.

Also associated with the displays are keypads 42,44 to permit data input to the CRIND microprocessor 40 in conventional fashion. An additional keypad 130 is provided aligned with one side of the screen 125. The individual keys of the keypad 130 can therefore have their functions defined to a user by a legend displayed on the screen adjacent the keys.

In the embodiment depicted in several of the drawing figures, video messages relating to the sale of a carwash are shown on the screen 125. Thus, in FIG. 1, the keys of the keypad 130 can permit the user to select in association with his or her carwash a hot wax, a tire scrub, or drying of the vehicle, at extra charges, simply by pressing the associated adjacent key. If desired, the charges for the carwash options can be added to the fuel sale transaction charge when the customer's card is charged, by communicating the depression of a key on keypad 130 to the CRIND microprocessor. Similarly, the messages on the screen can call for the insertion of additional cash into the cash acceptor 24, or the like.

Figure 2:
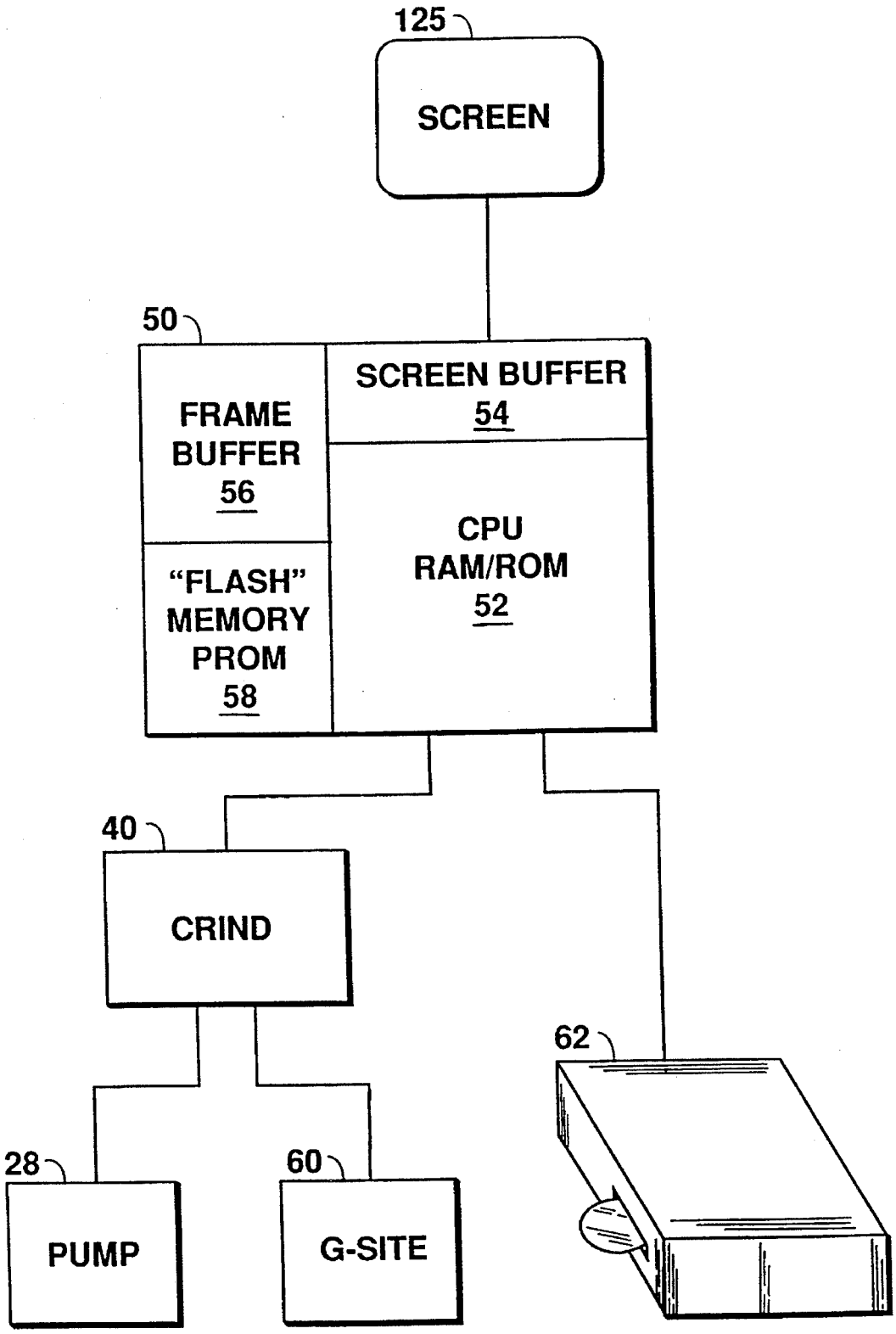
FIG. 2 is a block diagram of functional components of the fuel dispenser of FIG. 1.

FIG. 2 illustrates in a block diagram form various components of the electronics to make the display on the screen 125 possible. A video image data assembly module 50 is provided made up of one chip 52 having a central processing unit, a random access memory (RAM) and a read-only memory (ROM); a screen buffer chip 54; a frame buffer 56; and a "flash" programmable read-only memory 58. A frame buffer is an area of memory where bit mapped picture data is stored for display. While the chips can be located on a single printed circuit board to make up the video image data assembly module 50, various other arrangements can be substituted. For example, various of the functionalities of the chips 52,54,56,58 can be combined or separated either by a chip or by printed circuit boards.

The flash memory PROM 58 is included as a source of what is known as application data contents. Thus, in the fuel dispenser environment, a fuel dispenser could be sold to a service station which would want to customize its own video displays. It can do this by building the hierarchical linked list as described herein and providing the bit mapped images. These would be stored in the flash PROM and transferred to the RAM 52 at power up, and the graphics copied to the frame buffer 56. Otherwise, the linked list and frame buffer contents can be constructed from default values fixed in a non-visible portion of the frame buffer memory. Pointers to the font character locations are held in a font pointer table. In a preferred embodiment, the cpu RAM/ROM is provided as a Z80180 based microcomputer and the screen buffer and frame buffer are provided via an Hitachi HD 63484 graphics processor.

The various functions performed by the aforementioned chips could be performed by other hardware elements, as will be apparent to those of ordinary skill in the art. Those alternate embodiments are deemed to be within the scope of the present invention.

The apparatus also includes a television signal source 62, such as a video disk player, video cassette recorder, live television camera or the like.

Briefly stated, the video image data assembly module 50, after initialization, uses an operating system stored in the ROM portion 52 to respond to commands from the CRIND 40. It does so by loading linked lists of data elements in the RAM portion from the flash prom 58. The linked list relate to various display elements to be depicted on the screen 125 in a hierarchical arrangement. Those linked lists have addresses to the frame buffer 56 in which depictions of the elements to appear on the screen 125 reside. When a command is received from the CRIND 40, the linked list is reviewed to see which portions of the list are called for by the command, and the relevant data is then written from the frame buffer 56 to the screen buffer 54. The screen buffer 54 can then directly output the signal in a raster-scan fashion to the screen 125.

Linked list data structures are known data structures and are preferred in the present invention. However, there are other pointer-based data structures which could be used in lieu of the linked list, such as B-trees, and all such linked data structures are deemed to be within the scope of the invention.

Figure 3:
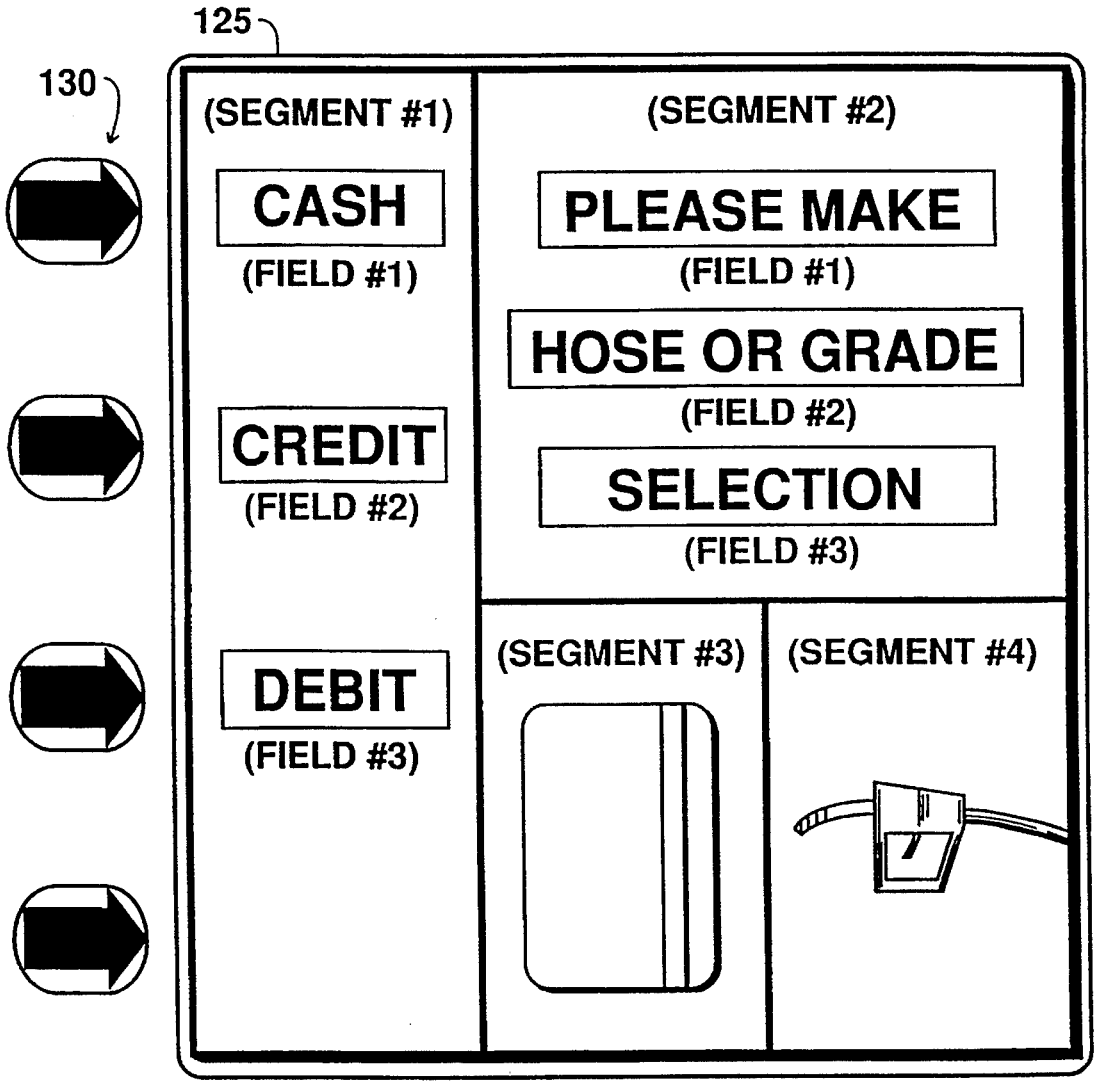
FIGS. 3–6 are views of possible screen displays for use on the screen of the embodiment of FIG. 1.

What is listed in the linked lists are indications of the various parameters for various levels of what is being displayed, where it is to be displayed, and how it is to be displayed. For example, in the fuel dispenser 12, there is typically a second screen on the other side of the dispenser 12 serving customers on the other side. A first level of detail can be an instruction to select one of those two screens as the display. In the nomenclature of the present invention, which of the two screens would be an instruction at the display object level. As to each display screen, there are further levels of display objects, segment objects, and field objects. These can be seen better in FIGS. 3–4. First, at the screen object level, the overall background color can be specified, along with other parameters, such as whether the screen is to flash on and off or the like. In FIG. 3, the screen is broken into four segments, outlined in a heavy black line. For example, segment 1 is vertically elongated in FIG. 3. Segment 2 is elongated horizontally, and segments 3 and 4 are positioned below segment 2. The segment definitions in the lists corresponding to those segments specify the size and location of the segments as well as background color for that segment. The segments may also include instructions to include a picture such as the gasoline nozzle shown in segment 4 or a credit card and its magnetic stripe as shown in segment 3.

Within segment 1 of FIG. 3 are three fields whose position and size are determined by parameters in the field list linked to segment 1. As will be apparent, there are three fields also provided with respect to segment 2 having different sizes, locations and contents from the similarly enumerated fields for segment 1. However, because of the hierarchical pointers of the linked lists, the calling of segment 2 necessarily calls also the three fields of segment 2 as depicted in FIG. 3, rather than three other fields, such as those shown in segment 1 of FIG. 3.

Figure 4:
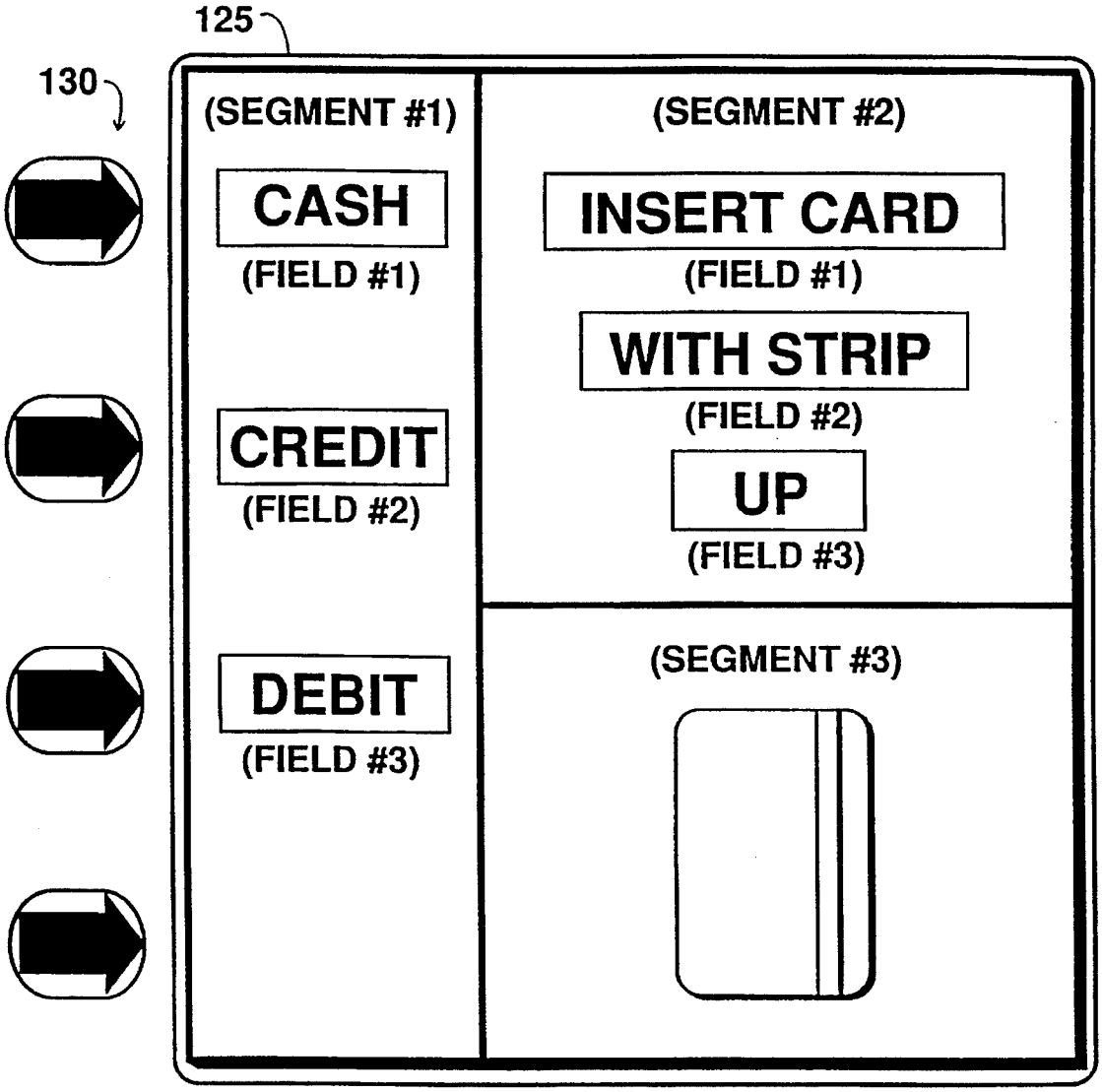

FIG. 4 shows a display screen 125 similar to the one shown in FIG. 3, with similar segments 1 and 2. However, segment 2 in this case has different fields. The different fields are called by segment 2 differently than they were in FIG. 3 because a different screen object has called segment 2 in FIG. 4 from the screen object calling segment 2 in FIG. 3. However, the instructions for segment 1 include the same fields as the instructions for segment 1 of FIG. 3. Also the segment 2 of FIG. 4 is different than the segment 2 of FIG. 3, being somewhat smaller. The different segment 2 of FIG. 4 also calls, therefore, different fields 1, 2 and 3, with varying contents.

Figure 5:
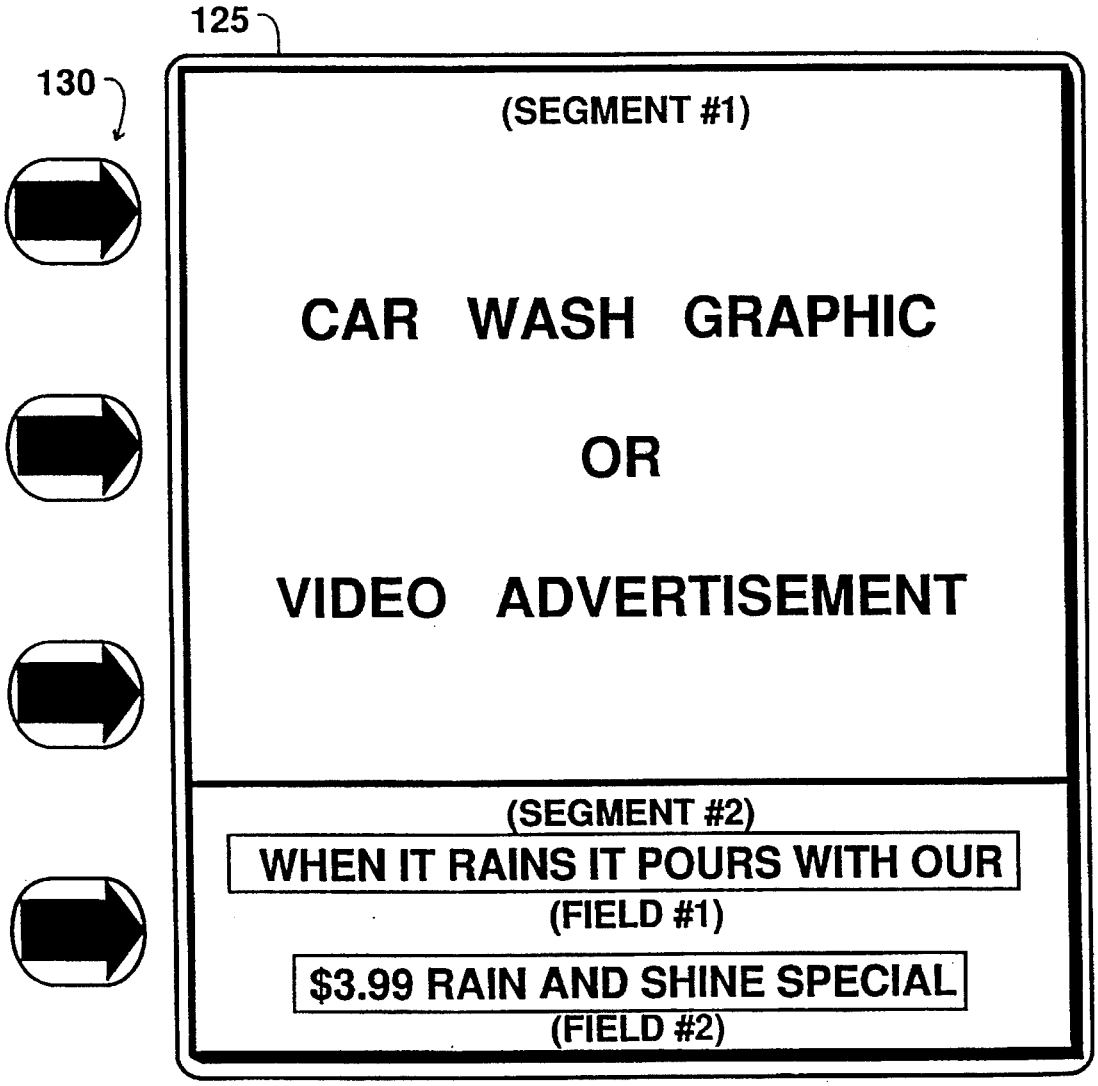

FIG. 5 depicts a screen display having a large upper segment 1 on which a television video from the television source 62 of FIG. 2 can be depicted during the fueling. The segment 2, with its two necessarily associated fields 1 and 2 can provide the customer with helpful information, as shown in FIG. 5.

Figure 6:
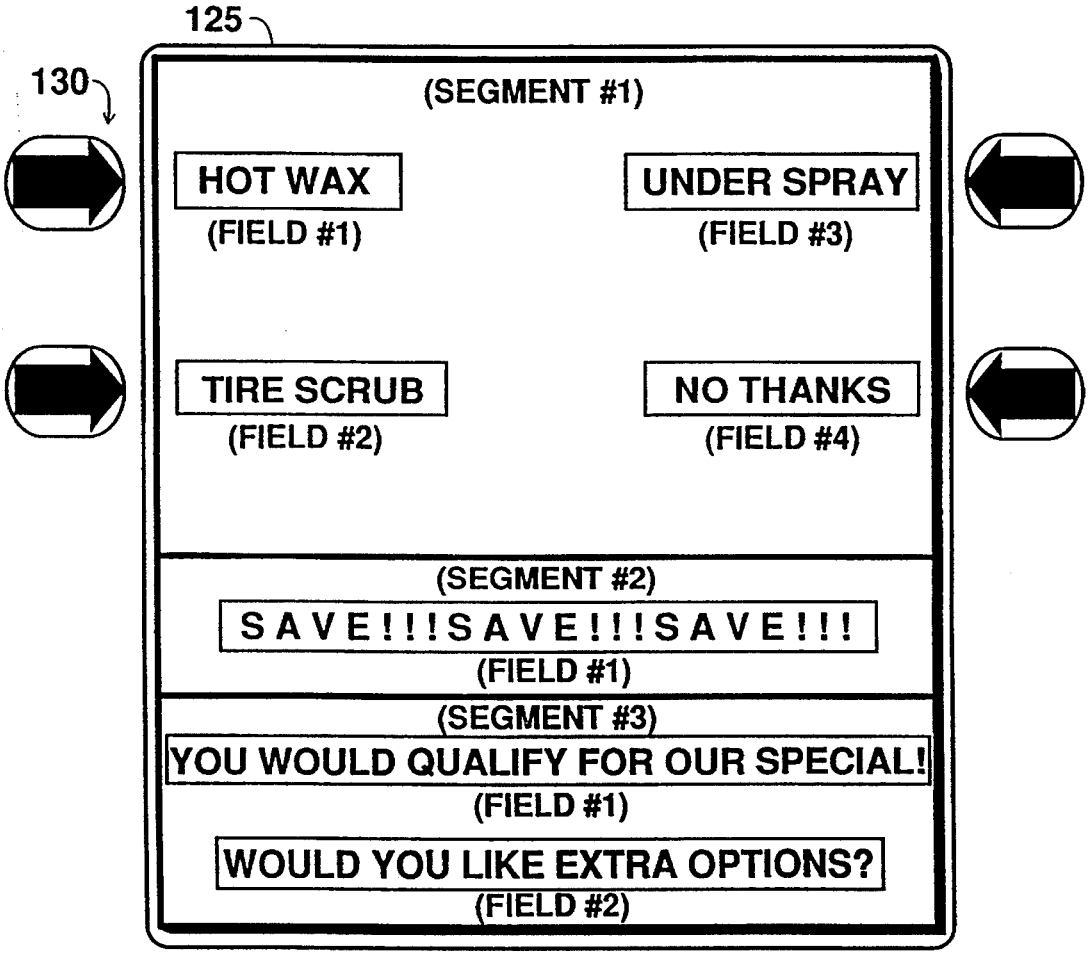

FIG. 6 shows a different arrangement of the options available to the fueling customer for selecting options for a carwash. FIG. 6 depicts four upper buttons being available to a customer, as distinguished from the four side-mounted buttons of FIG. 1, to enable the customer to select his or her choice as to carwash options, The button number and placement can be as desired for any given application.

Commands from the CRIND microprocessor 40 of FIG. 2 have a fixed block header and a variable length data field. That is, the command will have a header specifying the type of action to be completed. It will also have specifications for the display object, screen object, segment object and field object, x-position, y-position, attribute (such as flash, scroll or rotate of a display information) font, background color and additional possible variable length data. As the command is being executed, it branches through the various legs of the hierarchical data structure to find the information needed to combine the various data elements into a full screen display.

A C data structure is used as the communications receive buffer for the message level protocol traffic received from the CRIND microprocessor 40. Each fixed length field of a CRIND message is placed in its respective element of the data structure. The received data is then accessible to the software by its field name. The variable length data message is terminated with a null character upon receipt.

Similarly, responses can be sent from the video image data assembly module to the CRIND microprocessor acknowledging receipt and performance of commands received from the CRIND, or providing error messages indicating problems.

Other commands are optional and will be determined by the particular point-of-sale application. Useful commands are add/delete object commands, and a download data command to cause the system to accept and process downloaded information from the CRIND microprocessor. This function provides for a transfer of application screen descriptions and bit mapped image data. Other commands may relate to I/O access to provide the point-of-sale computer with access to peripheral devices.

Figure 7:
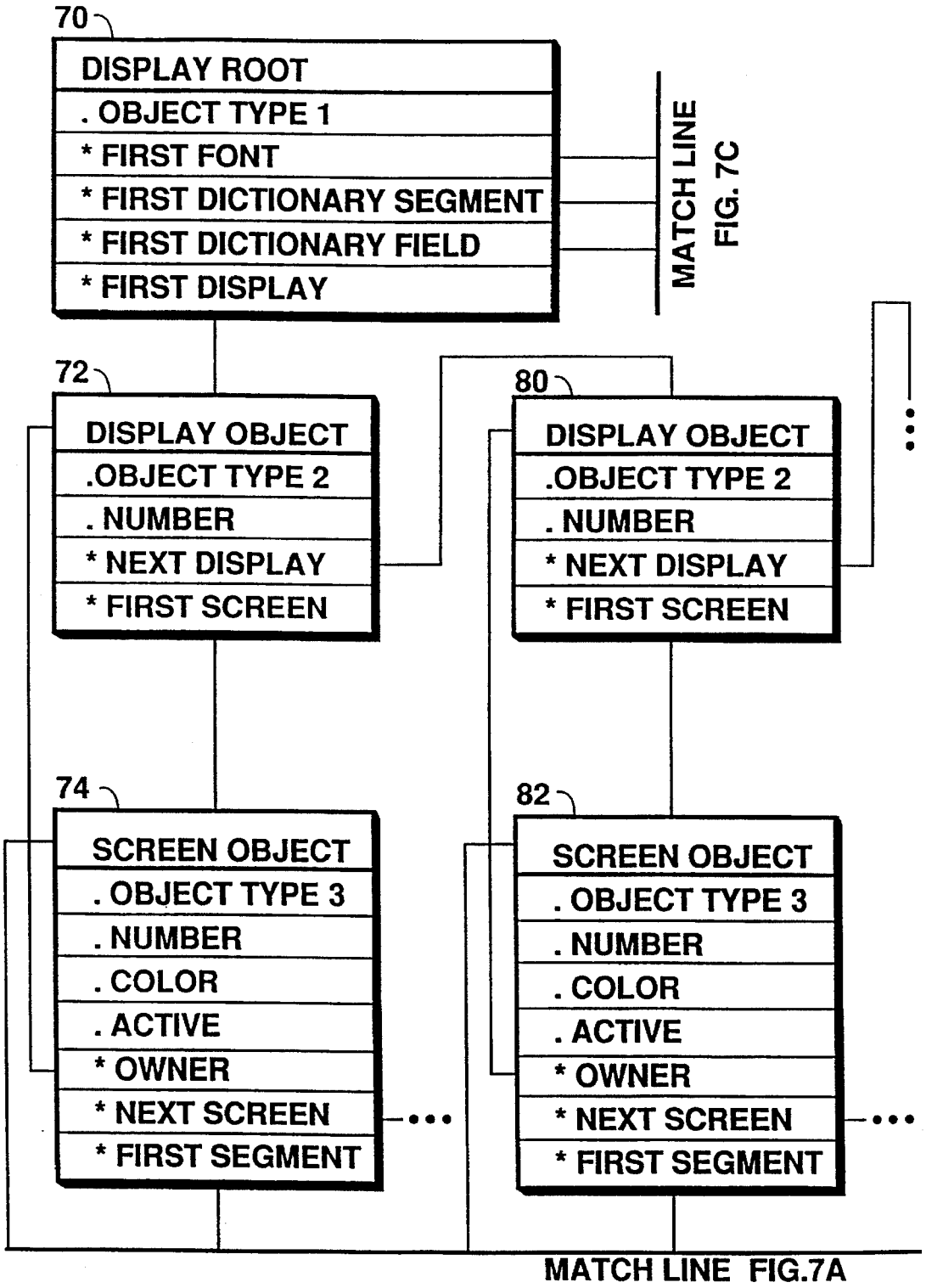
FIGS. 7–9 are tables of data elements arranged in hierarchical fashion like the storage of data in link lists.
Figure 7A:
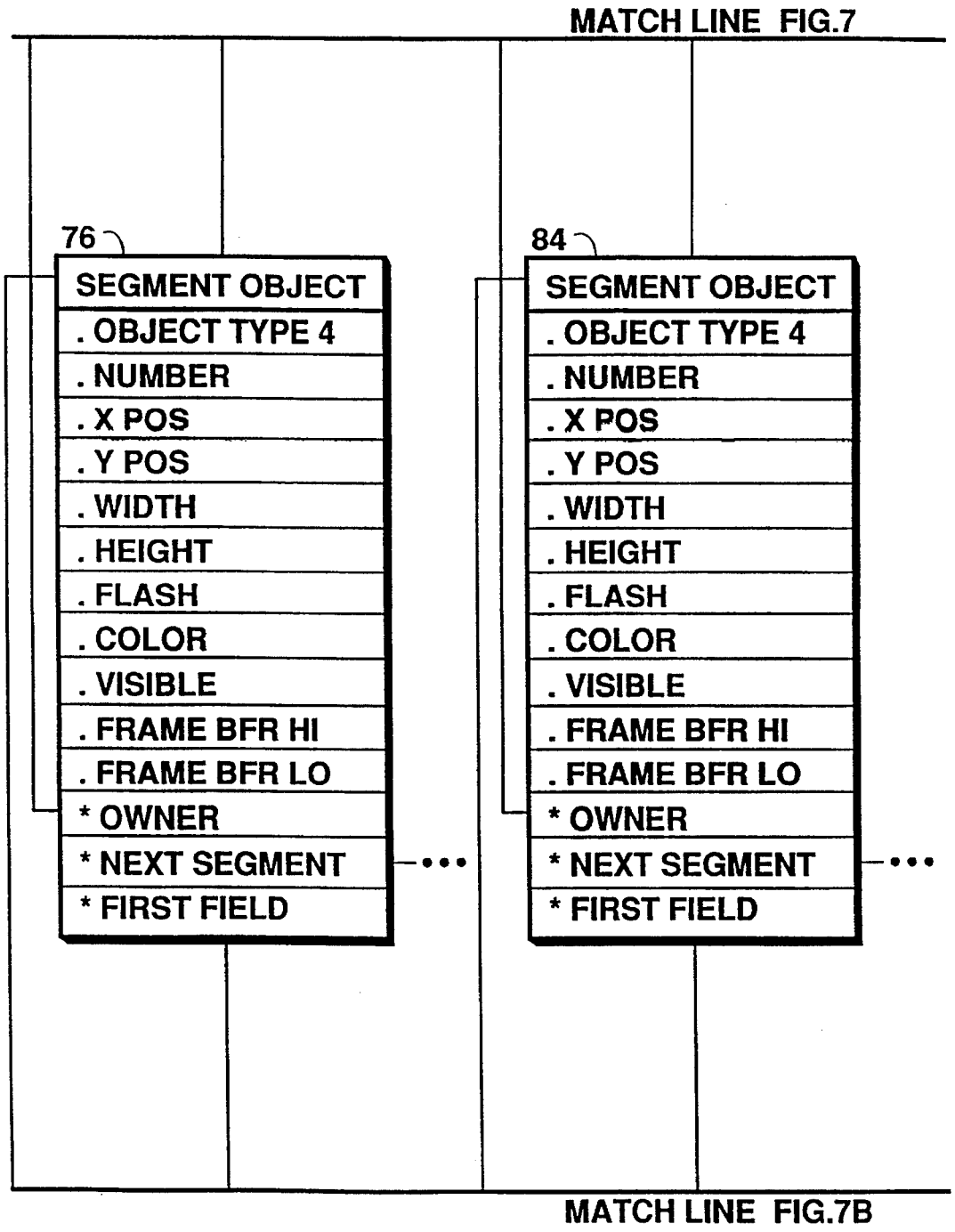
Figure 7B:
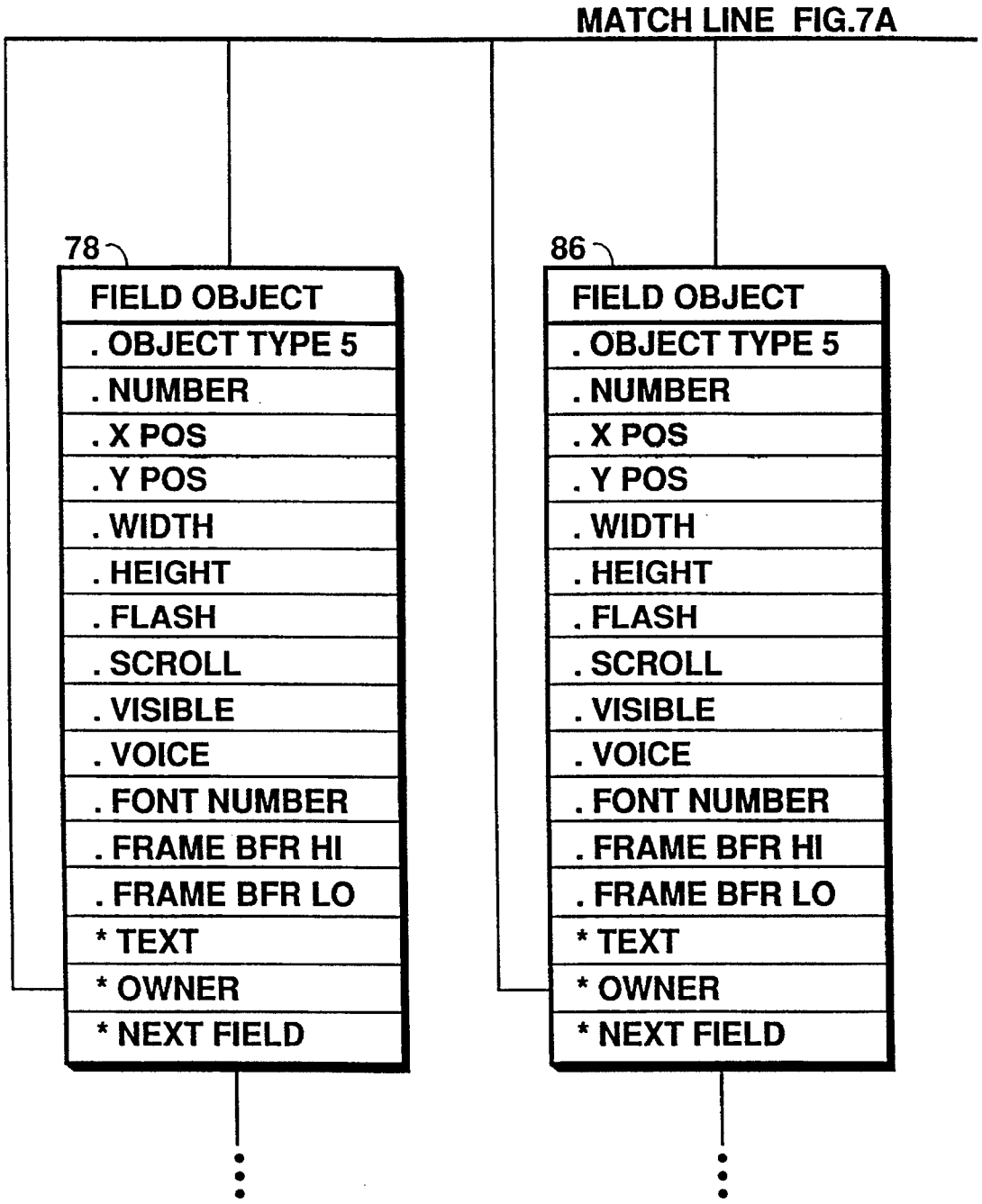
Figure 7C:
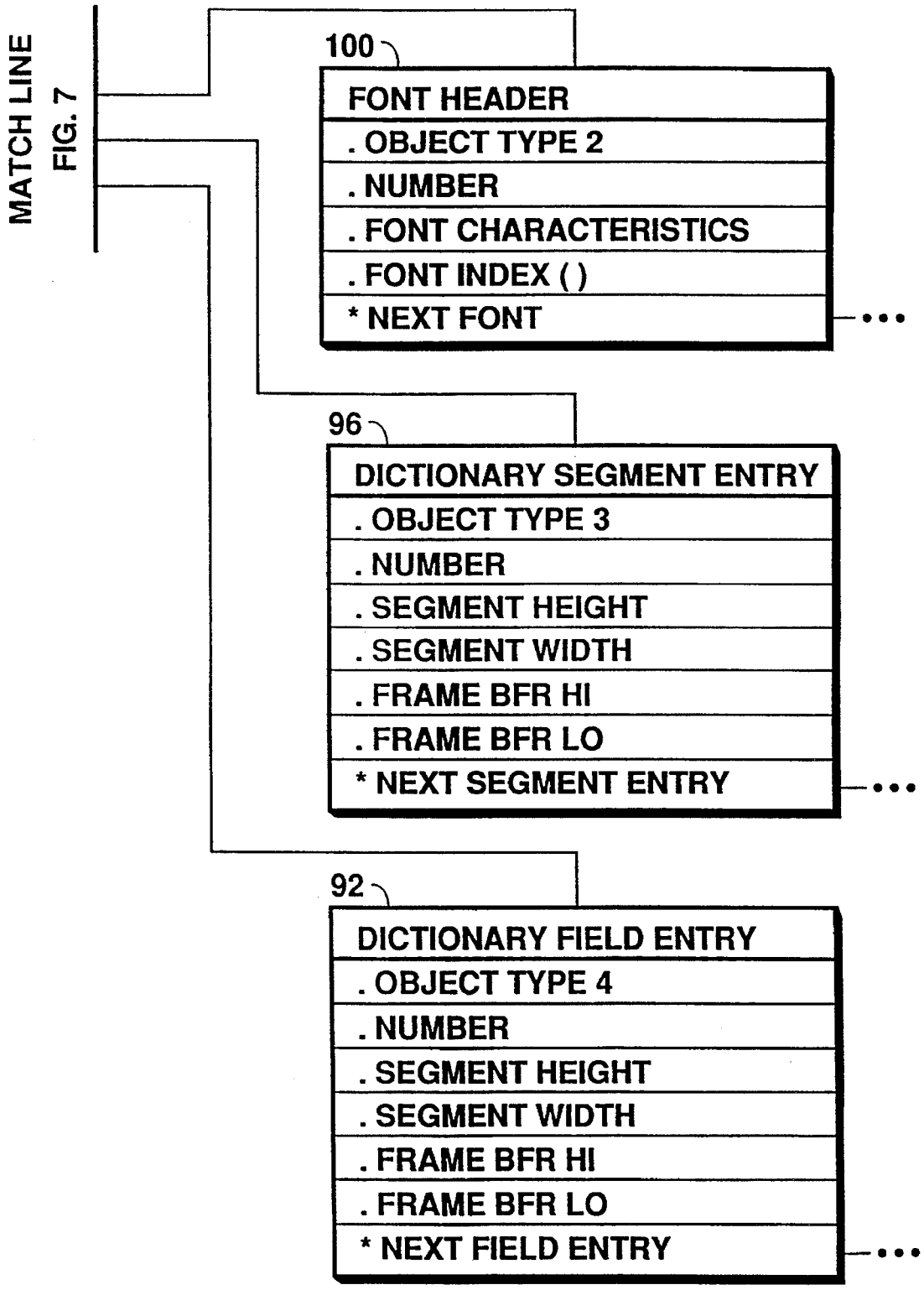

FIG. 7 illustrates the various relationships of linked lists usable in the present invention. The lists are linked in a hierarchical structure, starting in a root. In FIG. 7, the hierarchy starts at the top with a display root 70. Within the display root is a notation that it refers to an object type 1, a nomenclature meaning "display root". (Similarly, box 72 includes the phrase "display object" and "object type 2", both having the same meaning for the purposes of the system.) Box 70 has the reference "* first display", constituting a pointer to point to the first display object 72. Display object 72 includes a reference "object type 2" indicating that the object type is a display object. Then there is a reference to a number, indicating that it is display number 1, or whatever is the display number assigned to that display object. The next two lines constitute pointers to two other boxes. Thus, "*next display" is a pointer to display object box 80, and "* first screen" is a pointer to screen object box 74.

The effect of these pointers is that, as the program progresses through the hierarchical list under a command from the CRIND microprocessor 40, it looks for a match of parameters given to it. If the object type 2 portion of the command being acted on matches with the number listed in box 72, then it is ascertained that the appropriate display object has been found, and the first screen is examined in screen object box 74. If not, the search proceeds to display object box 80, to see if its number matches. Additional display objects could also be examined, if appropriate and as noted in FIG. 7, by the dotted line from the "*next display" line of display object box 80.

When a display object is found, the search progresses to a screen, such as screen object box 74. The number of the screen denoted in the command being implemented is checked to see if it matches with the screen object number listed in box 74. If not, the search proceeds to a next screen object box, as denoted by the dotted line to the right of screen object box 74. If it is found, the value for the screen color given in screen object box 74 is adopted as being the background color to be denoted on the display screen 125. Also, whether or not the screen is really to be shown on the display screen 125 is indicated by the parameter "active."

Then, the first segment is examined in segment object box 76. Again, the number is first checked to see if the segment number is appropriate for the command under consideration. If not, the next segment is proceeded to, as denoted by the dotted line to the right of segment object box 76. If the number is correct, the x-position, y-position, width and height of the segment are considered as being active, and the segment's attributes of color and whether it is to flash on and off are denoted. Similarly, frame buffer high and frame buffer low attributes are adopted, indicating upper and lower address locations in the frame buffer 56 where the data elements to be displayed may be located.

In addition, since there may be several segment objects for each screen object, the next segment search is proceeded with to the right, even if the number found in the segment object box 76 is correct, since there may be several active segment objects for each screen object. (This is also done for additional screen objects for each display object.)

At this point, it is appropriate to note that each object box below the display box 70 includes a reference and pointer back to a "* owner". This assists in ascertaining which segment objects or the like are associated with which screen objects, or other higher order object.

Once a segment object has been selected, the field portion of the command is checked to see if it matches with the number of a field object, such as the field object shown in box 78. Again, x-position, y-position, width, height are adopted for that field within the associated segment. The x-position and y-position values are horizontal pixel coordinates for the upper left corner of the rectangular area for the field in the segment object. "Visible" determines whether the field is to be made visible or not. "Voice" flags text data for speech processing, if that capability is provided. Also, attributes such as whether the text in the field is to flash on and off or to scroll or to be depicted in a particular font are adopted. Finally, the field object also includes references to high and low addresses in the frame buffer in which the text to be depicted in the field is stored. As with the segments within screens, there may be multiple fields within a segment, and so the search proceeds to other fields linked to the field object box 78 for similar selection of the sizes, locations and attributes for those fields.

In the event that the display object number in box 72 is not appropriate, the search proceeds to display object box 80. If that number is correct, then the same procedure is used for screen object box 82, segment object box 84 and field object box 86 as described above with reference to the other screen, segment and field object boxes.

Figure 8:
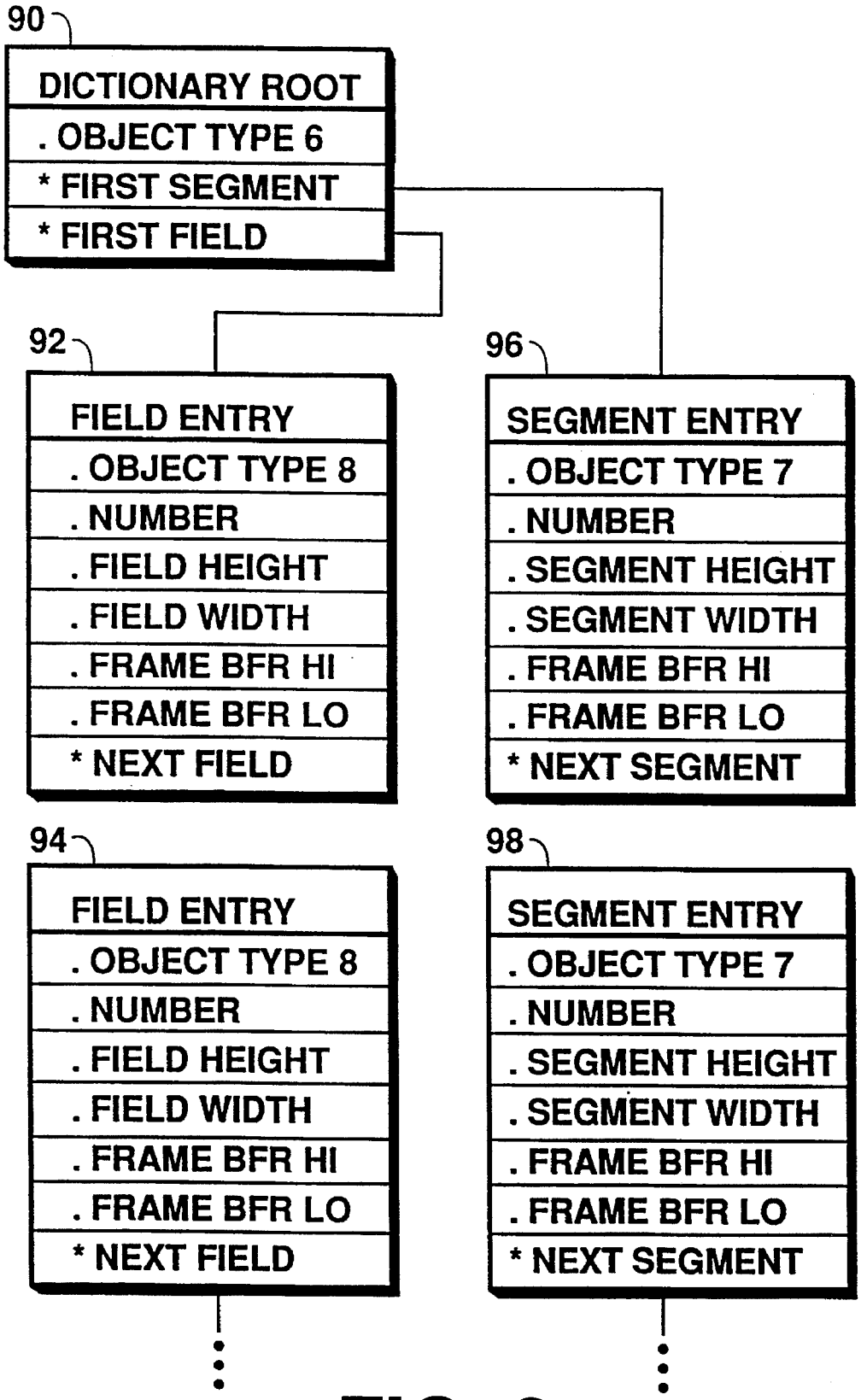

FIG. 8 depicts another linked list arrangement for use in changing the segment and field objects, namely a dictionary. The dictionary provides another access mode to the pictures and graphics stored in the frame buffer. Thus, when a new segment or field is to use the same picture or graphic as an established segment or field, it is not necessary to download the bitmapped image again or to duplicate it in the frame buffer. All that is needed is to look for the picture or graphic in the dictionary and copy its address to the newly-defined segment or field. The dictionary is used in carrying out an "Add segment" or "Add field" command from the CRIND microprocessor 40. These commands include specifications of which dictionary entry is to be added. If the command is to add a segment object, the command starts at the dictionary root (a part of the display root) and follows the segment entry pointers to the segment entry box 96 to look for a match. If it is found, the parameters (especially the frame buffer addresses) are copied to the segment object being set up. If not, it continues down the hierarchy to box 98 and so on. If no match is found, an error message is returned to the CRIND microprocessor 40.

If a field object is to be added (because the CRIND microprocessor 40 has issued an "Add field" command), the field entries 92, 94 etc. are examined in similar fashion.

Figure 9:
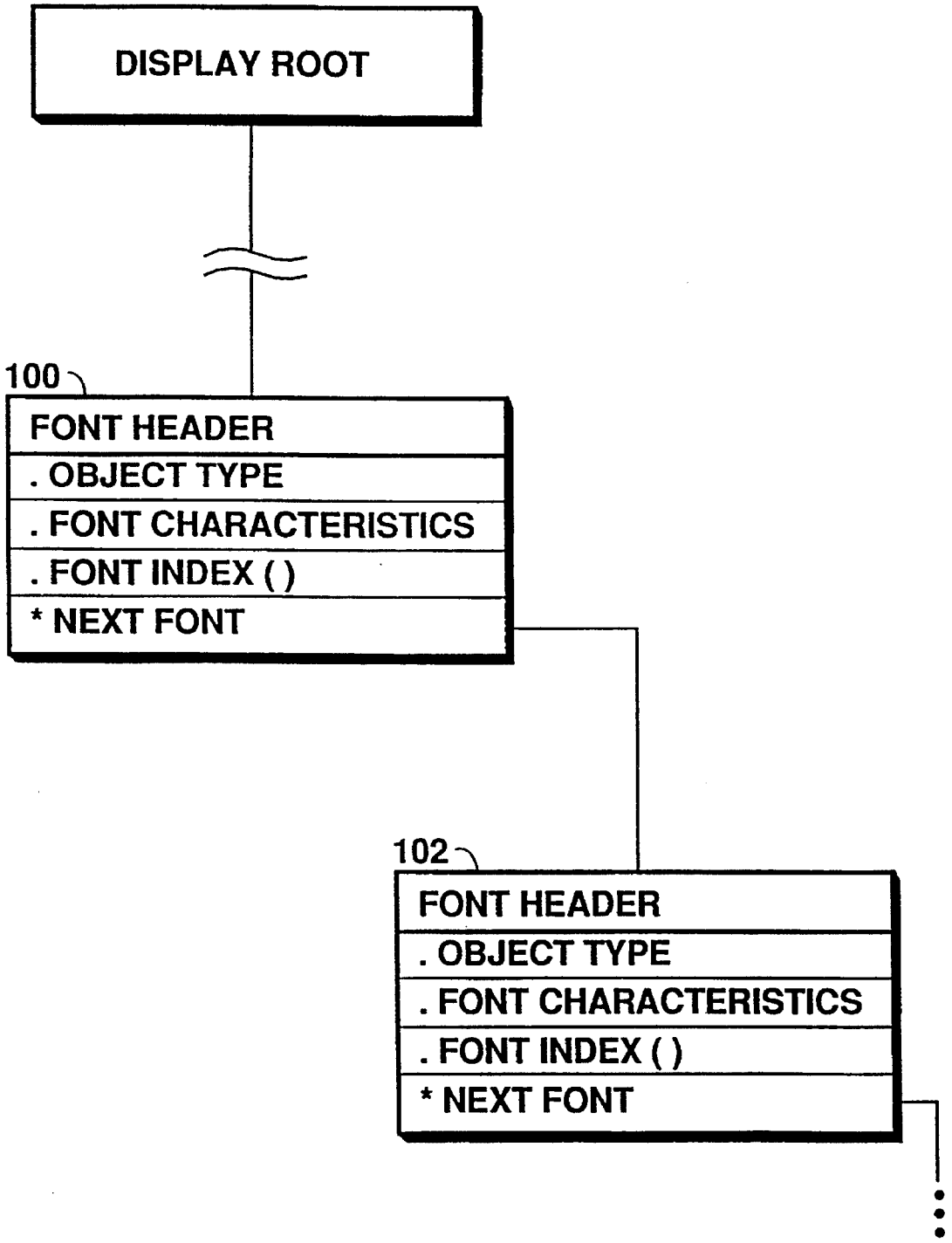

If it is desired to show the text, typically alphanumeric text, in a field in a specific font, a field object, such as field object box 78 or 86, can call a linked list of fonts, such as those shown in FIG. 9. For example, the box 78 includes a font number that can be found by a search through the linked list of FIG. 9 to find a font matching that font number. The font element with the matching number has a frame buffer address in its font index where can be found bitmapped ASCII text characters for that font. The font index is an array containing the coordinates in the frame buffer for each bitmapped character in the font. When the correct font is found by its specified number, the index is then used as the source coordinates in the frame buffer for copying the bitmapped characters to the screen buffer.

For example, say font 5 was specified in the field object and was found in the font headers. At this point, the ASCII character code values in the field object ASCII string are used as indexes into the array to extract the frame buffer coordinates for each character. These coordinates are then used to copy the bitmapped font character to the screen buffer.

The font characteristics specified in the block diagram of FIG. 9 relate to a particular font set, and as such, are different for each font. Typically, they are character height, character color, shadow color, intercharacter spacing, etc.

Alternatively, the command received at the display root from the CRIND microprocessor can search several of the hierarchical paths parallel to one another. This requires more complexity in the commands applied and is therefore less preferred, but is still within the scope of the invention. That is, the display root can have links directly to the font header 100 or the dictionary root as well as the display object 72. Similarly, one or more of screen object, segment object or field objects can be searched directly from the display object 70, as long as there is some hierarchical relationship between members dependent from the display root.

One of the advantages of using a linked list arrangement is that it provides a dynamic data structure. This allows flexibility. It is impossible in many cases to predict ahead of time how many and what types of objects will be created for a given application. Thus, it is difficult to predict how much RAM will be needed. The linked list avoids this concern because each time a display object, screen object, etc is added via a command from the CRIND, new RAM is allocated for this object, and the object is linked into the existing lists.

It should be appreciated that the parameters for the various objects can vary widely. For example, the segment object can define a segment of essentially zero width or height so that a subservient field would be written directly onto the background of the screen defined by the screen object.

Figure 10:
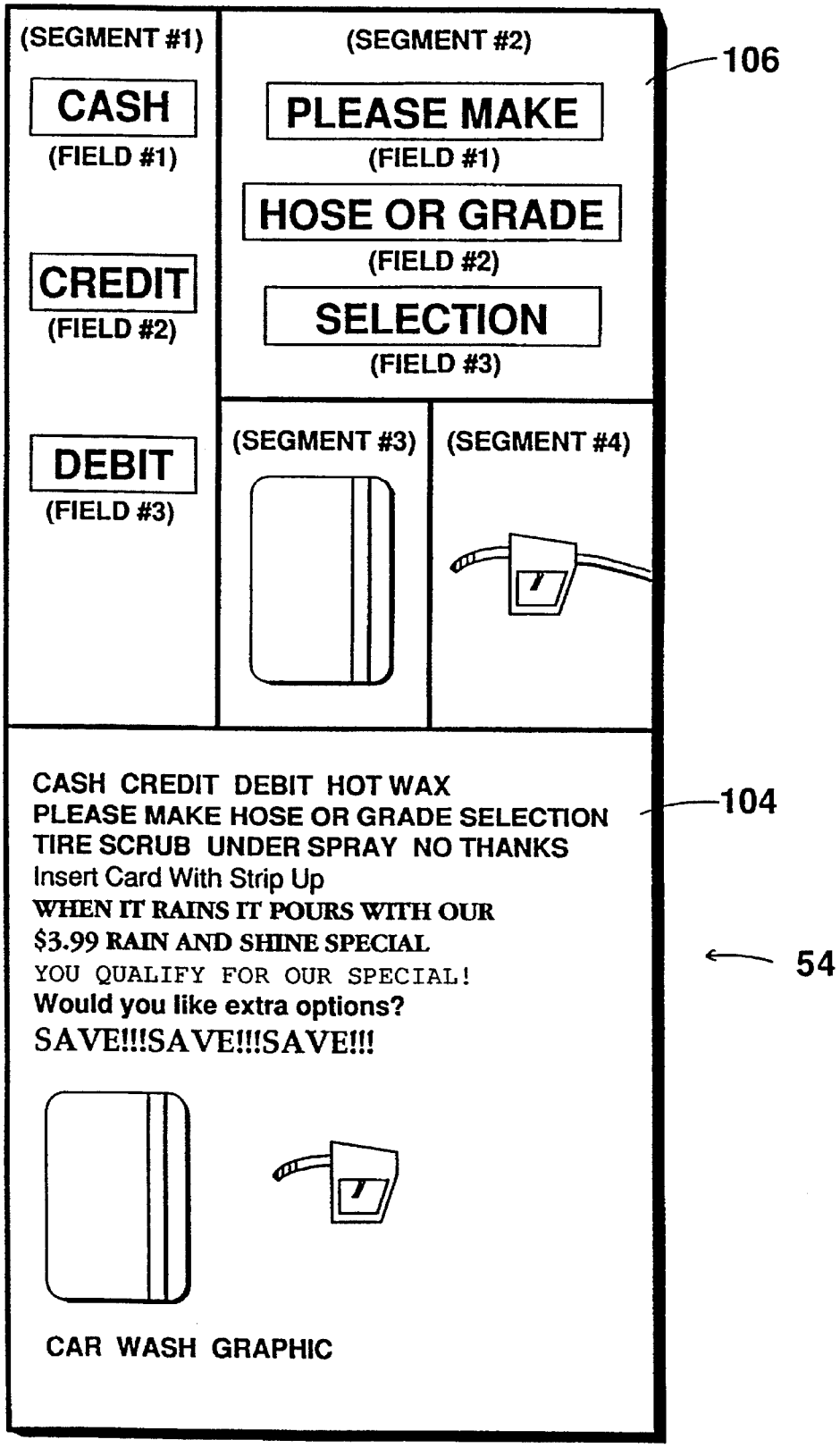
FIG. 10 is a schematic illustration of the storage of screen objects in a frame buffer memory.

FIG. 10 depicts in a rough form a frame buffer memory 54. It includes a lower portion 104 having stored within it various phrases and pictures to be shown on the display screen under various scenarios. The upper portion 106 shows some of those components arranged in a particular fashion, similar to the arrangement shown in FIG. 3. Thus, as the upper portion 106 is compiled, the frame buffer memory can be read directly into the screen buffer 54. For that matter, the upper portion 106 can in some circumstances serve as the screen buffer.

The process of video image data assembly then becomes a process of selecting portions of elements in the lower portion 104 of the frame buffer memory and moving them to the upper portion 106 under the control of the selected display object, screen object, etc. Also, the fonts to be used for the alphanumeric characters may be stored separately from the frame buffer memory, or within it. The lower portion 54 includes a reference to "carwash graphic", referring to a graphic picture, not easily depicted in the frame buffer memory, and therefore, not shown in that figure in graphical form.

Figure 11:
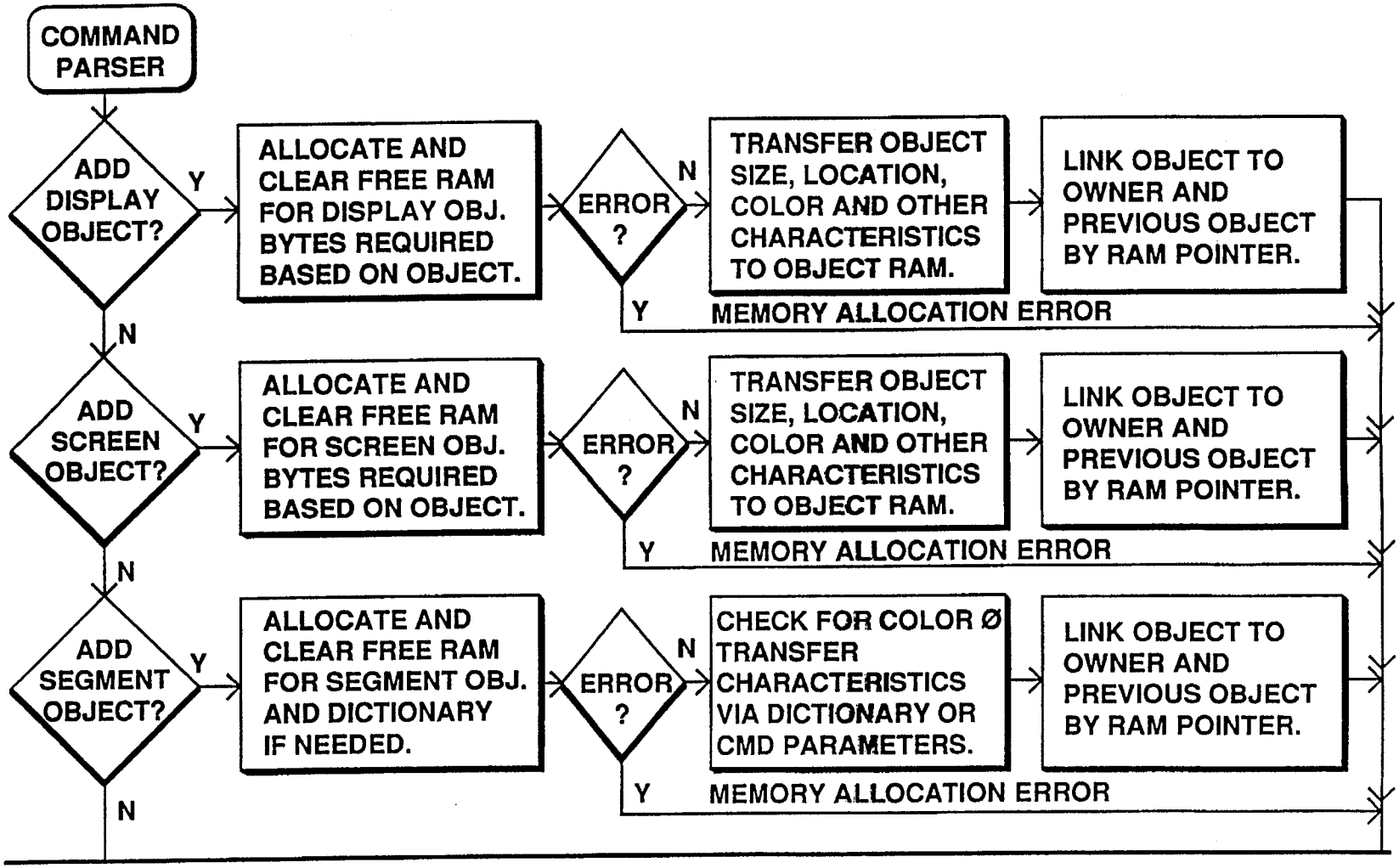
FIGS. 11 and 12 are flow charts of the processing of data element assembly into image data to be displayed on the screen.
Figure 11A:
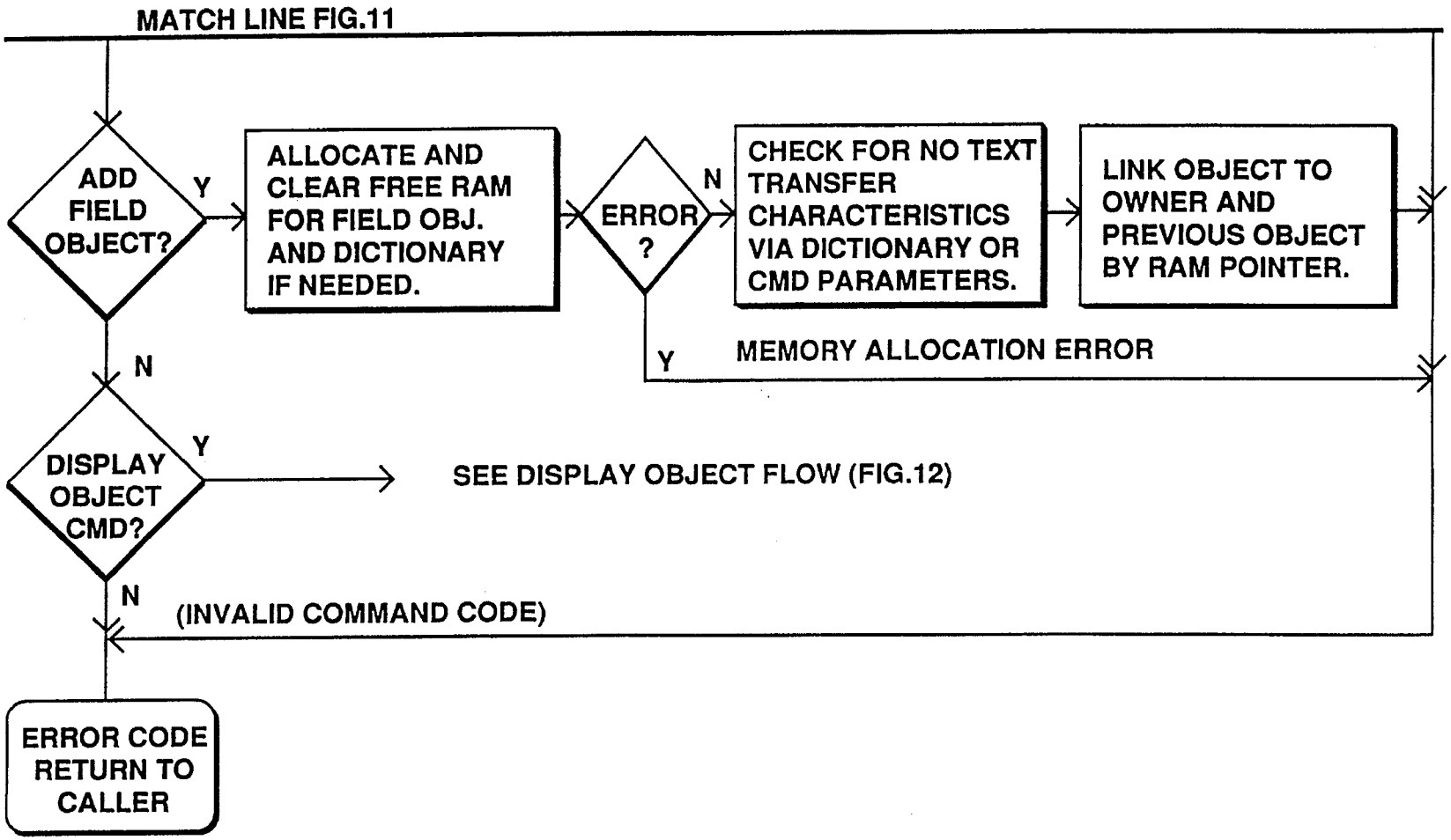

FIG. 11 shows in general form the process of executing a command received from the CRIND microprocessor 40. The command may add to (or replace) the memory stored in the RAM, with additional display objects, screen objects, segment objects or field objects, in which case the process proceeds by transferring those new objects into appropriate portions of the RAM and linking the object to the owner and a previous object by a RAM pointer. Thus, such a command would be executed at an appropriate one of the four horizontal flows across the top of FIG. 11.

Figure 12:
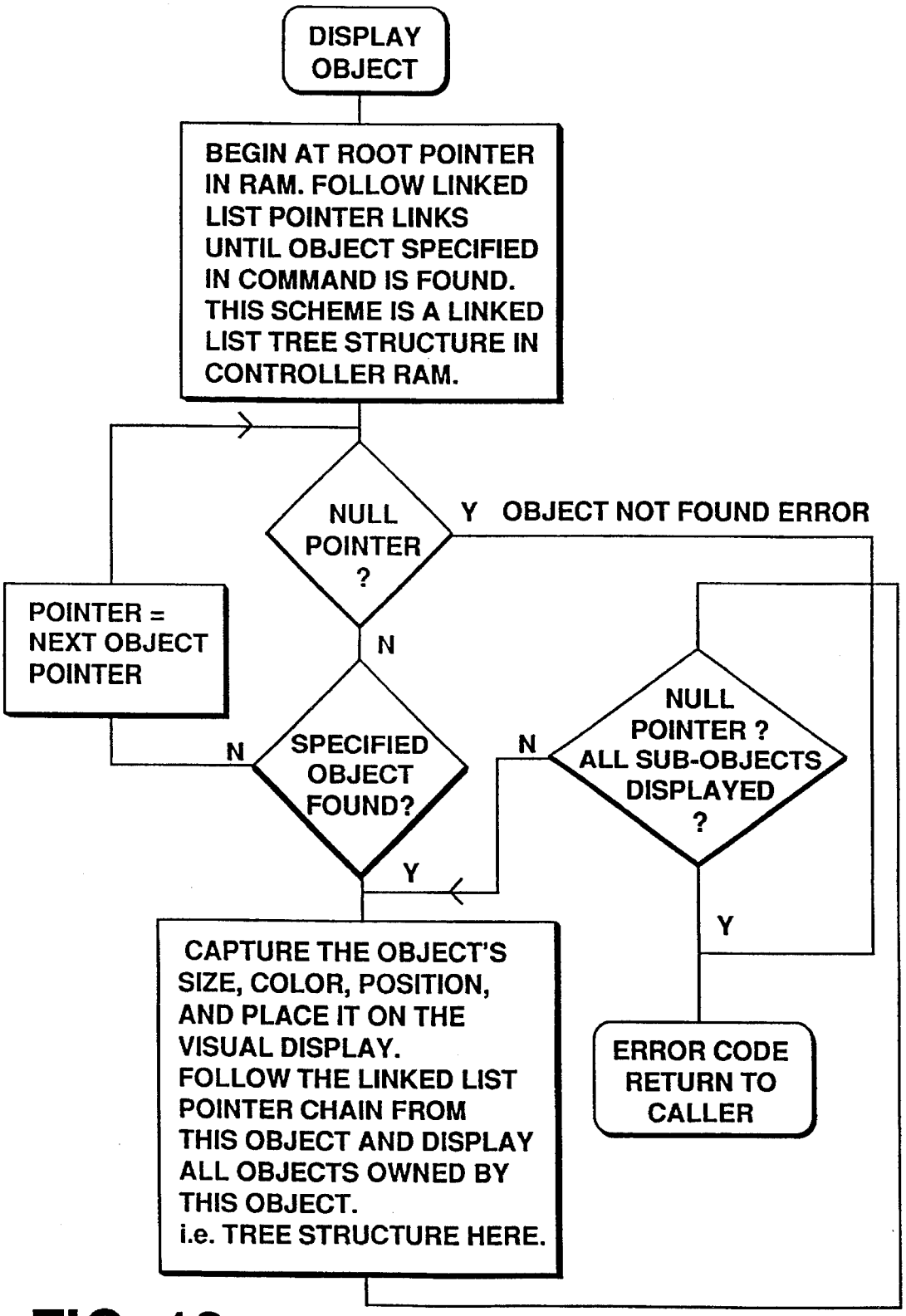

If the command is to display something on the screen display 125, the process of FIG. 12 is followed, by looking at the root pointer in the RAM and following linked list pointer links until the object specified in the command is found. This scheme is a linked list tree structure in a controller RAM. When the specified object is found, its size, color, position and other attributes are captured, and the linked list is followed through its pointer chain from this object. The items indicated by segment object addresses or field entry addresses found in the lower portion 104 of the frame buffer memory 54 are written to the upper portion 106, from whence they can be transferred for display on the display screen.

The graphic text image fields may be constructed using the bit mapped fonts. The various bit mapped font characters reside in a font area of the frame buffer and their descriptions reside in the controller RAM. When a word or string is to be displayed, the ASCII text characters of the word or string are matched to the font representations in the frame buffer. The matching font characters are assembled in a temporary frame buffer work area. When the matching process is complete, the graphic representation of the word or string is displayed and if specified, added to the field dictionary under the field number.

The invention is specifically designed to be used in conjunction with the inventions described in Glibarco Inc.'s copending applications entitled "Synchronization of Prerecorded AudioNideo Signals with Multi-Media Controllers" of Joseph Daniel Long and "Multi-media Graphics in Fuel Dispensers" of Russel Dean Leatherman and Walter Baker, both filed on even date herewith. The disclosures of those two applications are hereby incorporated herein by reference.

Those of ordinary skill in the art will appreciate that the invention can take many different forms and still fall within the scope of the notions taught herein. These are deemed to be within the scope of the invention.

What is claimed is:

1. An apparatus for displaying video information, comprising:

a video display screen, a storage device for holding a collection of output addressable image element lists linked to one another by a data structure including pointers between image element lists of the collection so that combinations of output addresses from first-pointed-to command responsive image element lists can be grouped with later-pointed-to command responsive image elements to define at least a portion of a display on said video display screen, a video image data assembly module adapted for responding to data commands by applying data commands to output addressable image element lists in said storage device and peripheral audio/video sources, said video image data assembly module further adapted for assembling output addresses representing at least three image element lists in order to compile a video image suitable for display on said video display screen, and a video image command module for transmitting data commands to said video image data assembly module to be applied over the data structure of output addressable image element lists in said storage device.

2. An apparatus as claimed in claim 1 wherein said video image data assembly module assembles the image data from identification of stored images in a frame buffer.

3. An apparatus as claimed in claim 1 wherein said video image data assembly module assembles responsive output addresses from a plurality of levels and branches in the data structure of output addressable image element lists.

4. An apparatus as claimed in claim 1 wherein said video image data assembly module further includes a screen buffer adapted for outputting chosen display elements from a frame buffer to said video display screen.

5. An apparatus as claimed in claim 1 wherein said video image data assembly module includes a communication link to receive data to be listed in a linked list for display.

6. An apparatus as claimed in claim 1 wherein said video image data assembly module assembles the image data from a plurality of groups of linked lists, one group defining the sizes and arrangements of screens, screen segments and fields within segments, a second group defining data to be displayed in a field or segment, and a third group defining fonts of typefaces for alphanumeric characters of the data to be displayed in the respective fields or segments.

7. An apparatus as claimed in claim 1 further comprising a television signal source supplying television signals to a portion of said video screen as directed by said image data assembly module.

8. An apparatus as claimed in claim 1 wherein said video image data assembly module includes a communication link to receive data indicative of which of the linked lists is to be selected for assembly into the video image and acts on such received data to assemble the video image.

9. An apparatus as claimed in claim 1 further comprising a frame buffer and wherein said video image data assembly module includes a communication link to receive font and graphic image data to be placed in said frame buffer and referenced by a linked list for display.

10. An apparatus as claimed in claim 1 wherein said video image data assembly module further includes a frame buffer having various display elements to be depicted on said video display screen, said frame buffer adapted for receiving grouped output addresses from responsive image element lists.

11. An apparatus as claimed in claim 1 wherein said video image data assembly module applies data commands received from said video command module over a plurality of levels and branches in the collection of output addressable image element lists.

12. An apparatus as claimed in claim 1 wherein said video image command module is a CRIND, said CRIND transmitting a terse data command having a header specifying the type of action to be completed as well as terse data commands specifications for the plurality of levels and branches within the data structure.

13. An apparatus as claimed in claim 1 wherein said video image data assembly module assembles responsive output addresses from image element lists linked in a hierarchical arrangement of most-significant to least-significant data elements.

14. An apparatus as claimed in claim 13 wherein said video image data assembly module selects data from an upper one of the members of a hierarchical list, and thereby selects data from a lower member by virtue of the linking of the lower member to the upper member.

15. An apparatus as claimed in claim 13 wherein said video image data assembly module selects data from a lower one of the members of a hierarchical list, and thereby selects data from an upper member by virtue of the linking of the lower member to the upper member.

16. An apparatus as claimed in claim 13 wherein said video image data assembly module may select data from one of the members of a hierarchical list without selecting other members of the hierarchical list.

17. An apparatus for displaying video information comprising a video display screen, a screen buffer, a frame buffer for holding a collection of output addressable image element lists linked to one another by a data structure including pointers between image element lists of the collection so that combinations of output addresses from first-pointed-to command responsive image element lists can be grouped with later-pointed-to command responsive image elements in order to define, at least a portion of a display on said video display screen a video image data assembly module adapted for responding to data commands by applying data commands to the output addressable image element lists in said storage device, said video image data assembly module further adapted for assembling output addresses representing at least three image element lists in order to compile a video image suitable for display on said video display screen, and assembling responsive output addresses from said image element lists linked in a hierarchical arrangement of most-significant to least-significant data elements, with significance dented by the usual size of the image element as displayed on said screen, so that selecting data elements located at any one of the output addresses of one the hierarchical arranged image element lists thereby selects data elements located at the output addresses of another of the image element lists by virtue of the linking the one output address to the other output address, a television signal source supplying television signals to a portion of said video screen as directed by said image data assembly module, and a communication link to said video image data assembly module to receive data to be listed in a linked list for display and to receive data indicative of which of the linked lists are to be selected for assembly into the video image.

18. An apparatus as claimed in claim 14 wherein said video image data assembly module assembles the image data from references in a plurality of groups of linked lists, one group defining the sizes and arrangements of screens, screen segments and fields within segments, a second group defining data to be displayed in a field or segment, and a third group defining fonts of typefaces for alphanumeric characters of the data to be displayed in the respective fields or segments.

19. An apparatus for displaying video information comprising:

a video display screen, a storage device for holding a collection of output addressable image element lists linked to one another by a data structure including pointers between image element lists of the collection so that combinations of output addresses from first-pointed-to command responsive image element lists can be grouped with later-pointed-to command responsive image elements in order to define at least a portion of a display on said video display screen, a video image data assembly module adapted for responding to data commands by applying data commands to the output addressable image element lists in said storage device, said video image data assembly module further adapted for assembling output addresses representing at least three image element lists in order to compile a video image suitable for display on said video display screen, and a video image command module for transmitting data commands to said video image data assembly module to be applied over the data structure of output addressable image element lists in said storage device.

20. A fuel dispenser for dispensing fuel, comprising:

fuel delivery mechanism, a transaction computer, and apparatus for displaying video information to a fuel customer including a video display screen.

a storage device for holding a collection of output addressable image element lists linked to one another by a data structure including pointers between image element lists of the collection so that combinations of output addresses from first-pointed-to command responsive image element lists can be grouped with later:pointed-to command responsive image element in order to define at least a portion of a display on said video display screen, and a video image data assembly module adapted for responding to data commands by applying data commands to the output addressable image element lists in said storage device, said video image data assembly module further adapted for assembling output addresses representing at least three image element lists in order to compile a video image suitable for display on said video display screen.

21. A method of displaying video information, comprising:

providing a video display screen, and electronically assembling data from a collection of output addressable image element lists linked to one another by a data structure including pointers between image element lists of the collection so that combinations of output addresses from first pointed to command responsive image element lists can be grouped with later pointed to command responsive image element in order to simultaneously display responsive image element lists on respective portions of said video display screen, and displaying the assembled data on the video display screen.

22. A method as claimed in claim 21 wherein said assembling step includes assembling the image data from identification of stored images in a frame buffer.

23. A method as claimed in claim 21 wherein said assembling step includes assembling the image data from linked lists of screen objects, segment objects and field objects.

24. A method as claimed in claim 21 wherein said assembling step includes storing the assembled image data in a screen buffer.

25. A method as claimed in claim 21 further comprising the preliminary step of receiving font and graphic image data and placing such font and graphic image data in a frame buffer referenced by a linked list for display.

26. A method as claimed in claim 21 wherein said assembling step includes assembling the image data from references in linked lists in which the data elements in the lists are linked in a hierarchical arrangement of most-significant to least-significant data elements.

27. A method as claimed in claim 26 wherein said assembling step includes selecting data from a lower one of the members of a hierarchical list, and thereby selecting data from an upper member by virtue of the linking of the lower member to the upper member.

28. A method as claimed in claim 26 wherein said assembling step includes selecting data from one of the members of a hierarchical list without selecting other members of the hierarchical list.

29. A method as claimed in claim 26 wherein the assembling step includes selecting data from an upper one of the members of a hierarchical list, and thereby selecting data from a lower member by virtue of the linking of the lower member to the upper member.

30. A method as claimed in claim 21 wherein said assembling step includes receiving data to be listed in a linked list for display.

31. A method as claimed in claim 21 wherein said assembling step includes assembling the image data from a plurality of groups of linked lists, one group defining the sizes and arrangements of screens, screen segments and fields within segments, a second group defining data to be displayed in a field or segment, and a third group defining fonts of typefaces for alphanumeric characters of the data to be displayed in the respective fields or segments.

32. A method as claimed in claim 21 further comprising supplying television signals as data for one of the linked lists.

33. A method as claimed in claim 21 wherein said assembling step includes receiving data indicative of which of the linked lists is to be selected for assembly into the video image and acting on such received data to assemble the video image.

34. A method of displaying video information comprising receiving, arranging and storing data to be listed in a collection of output addressable image element lists linked to one another by a data structure including pointers between image element lists of the collection so that combinations of output addresses from first pointed to command responsive image element lists can be grouped with later pointed to command responsive image element in order to simultaneously display the responsive image element lists on respective portions of a video display screen receiving control data indicative of which of the output addressable image element lists is to be selected for assembly into a video image, acting on such received control data to electronically assemble a video image by applying the output addresses of the output addressable image element lists to actuate images stored in a frame buffer, writing the assembled video image data from a frame buffer to a screen butter, and outputting and displaying the assembled video image data from the screen buffer to the video display screen.

35. A method as claimed in claim 34 wherein said acting step includes assembling the image data from references in a plurality of groups of linked lists, one group defining the sizes and arrangements of screens, screen segments and fields within segments, a second group defining data to be displayed in a field or segment, and a third group defining fonts of typefaces for alphanumeric characters of the data to be displayed in the respective fields or segments.

36. A method of displaying video information, comprising:

organizing data in a collection of output addressable image element lists linked to one another by a data structure including pointers between image element lists of the collection so that combinations of output addresses from first pointed to command responsive image element lists can be grouped with later pointed to command responsive image element in order to simultaneously display the responsive image element lists on respective portions of a video display screen, providing a video display screen, and electronically assembling video images by applying responsive output addresses from the plurality of levels and branches of output addressable image element lists to trigger images stored in a frame buffer to be displayed on the screen.

37. A method of dispensing fuel comprising organizing and storing data in a collection of output addressable image element lists linked to one another by a data structure including pointers between image element lists of the collection so that combinations of output addresses from first-pointed-to command responsive image element lists can be grouped with later-pointed-to command responsive image elements in order to simultaneously display the responsive image element lists on respective portions of a video display screen, delivering fuel through a fuel delivery mechanism, computing the amount of fuel dispensed on a transaction computer, and displaying video information to a fuel customer on a video display screen by applying command data to a plurality of levels and branches of output addressable image element lists, applying the output addresses from responsive output addressable image element list to activate images stored in a frame buffer as well as from peripheral audio/video sources assembling responsive images to simultaneously display on respective portions of a display screen, writing the assembled video image data from the frame buffer to the screen buffer, and outputting the assembled video data from the screen buffer to a video display screen.

* * * * *